US006905384B2

(12) United States Patent
Miyazaki et al.

(10) Patent No.: US 6,905,384 B2
(45) Date of Patent: Jun. 14, 2005

(54) METHOD AND APPARATUS FOR MANUFACTURING IMAGE DISPLAYING APPARATUS

(75) Inventors: Toshihiko Miyazaki, Isehara (JP); Kohei Nakata, Machida (JP); Tetsuya Kaneko, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 495 days.

(21) Appl. No.: 09/781,305

(22) Filed: Feb. 13, 2001

(65) Prior Publication Data

US 2001/0034175 A1 Oct. 25, 2001

(30) Foreign Application Priority Data

Feb. 16, 2000 (JP) ..... 2000-038603

(51) Int. Cl.[7] ..... H01J 9/00
(52) U.S. Cl. ..... 445/25; 445/24; 445/38
(58) Field of Search ..... 445/5, 6, 24, 25, 445/38, 40–42, 59, 66, 70

(56) References Cited

U.S. PATENT DOCUMENTS

| | | | | | |
|---|---|---|---|---|---|
| 4,607,593 | A | | 8/1986 | Van Hemel | 118/719 |
| 5,066,883 | A | | 11/1991 | Yoshioka et al. | 313/309 |
| 5,433,639 | A | * | 7/1995 | Zahuta et al. | 445/40 |
| 5,564,958 | A | * | 10/1996 | Itoh et al. | 445/6 |
| 5,605,483 | A | | 2/1997 | Takeda et al. | 445/2 |
| 5,653,838 | A | * | 8/1997 | Hwang et al. | 156/104 |
| 5,697,825 | A | | 12/1997 | Dynka et al. | 445/25 |
| 5,749,763 | A | | 5/1998 | Yoshioka et al. | 445/51 |
| 5,827,102 | A | | 10/1998 | Watkins et al. | 445/25 |
| 5,876,260 | A | | 3/1999 | Pepi et al. | 445/25 |
| 6,004,181 | A | * | 12/1999 | Robinson | 445/70 |
| 6,049,168 | A | * | 4/2000 | Iosue et al. | 313/542 |
| 6,254,449 | B1 | * | 7/2001 | Nakanishi et al. | 445/25 |
| 6,479,944 | B2 | * | 11/2002 | Lee et al. | 315/169.4 |
| 6,702,636 | B2 | * | 3/2004 | Nakata et al. | 445/25 |
| 6,821,174 | B2 | * | 11/2004 | Nakata et al. | 445/6 |
| 2002/0039870 | A1 | * | 4/2002 | Kaneko et al. | 445/3 |

FOREIGN PATENT DOCUMENTS

| | | | |
|---|---|---|---|
| EP | 0 782 169 A1 | 7/1997 | H01J/31/12 |
| EP | 1 168 410 A1 | 1/2002 | H01J/9/39 |
| FR | 2 705 163 | 11/1994 | H01J/9/385 |
| JP | 61071533 | 4/1986 | H01J/9/38 |
| JP | 7-262929 | 10/1995 | |
| JP | 11-135018 | 5/1999 | |
| KR | 1999-0053755 | 7/1999 | |
| WO | WO 96/38855 | 12/1996 | |
| WO | WO 99/17329 | 4/1999 | H01J/9/26 |

OTHER PUBLICATIONS

W.P. Dyke et al., "Field Emission", Advances in Electronics and Electron Physics, vol. VIII, 1956, pp. 89–185.

(Continued)

*Primary Examiner*—Joseph Williams
*Assistant Examiner*—Dalei Dong
(74) *Attorney, Agent, or Firm*—Fitzpatrick, Cella, Harper & Scinto

(57) ABSTRACT

A method and an apparatus for manufacturing an image displaying apparatus having a display panel. A first substrate of the display panel on which a phosphor exciter is disposed and a second substrate of the display panel on which phosphors emitting light by the phosphor exciter is provided, are prepared under a vacuum atmosphere. Then, the first and the second substrates are carried in a getter processing chamber or bake processing chamber, and getter processing or bake processing is applied thereto under the vacuum atmosphere. After the processing, the first and the second substrates are carried in a seal processing chamber, where the substrates are heat sealed under the vacuum atmosphere. Thus, reduction of vacuum exhaust time and a high vacuum degree in manufacturing an image displaying apparatus is attained and efficiency of manufacturing is improved.

61 Claims, 3 Drawing Sheets

OTHER PUBLICATIONS

H. Araki, et al., "Electroforming and Electron Emission of Carbon Thin Films", Journal of th Vacuum Soc. of Japan, vol. 2–6, No. 1, 1983, pp. 22–29 (with English Abstract on p. 22).

G. Dittmer, "Electrical Conduction and Electron Emission of Discontinuous Thin Films", Thin Solid Films, 9, 1972 pp. 317–328.

M. Elinson, et al. "The Emission of Hot Electrons and the Field Emissions of Electrons From Tin Oxide", Radio Engineering and Electronic Physics, Jul. 1965, pp. 1290–1298.

C.A. Mead, "Operation of Tunnel–Emission Devices," J. Applied Physics, vol. 32, No. 4, Apr. 1961, pp. 646–652.

C.A. Spindt et al., "Physical Properties of Thin Films of Thin–film Field Emission Cathodes with Molybdenum Cases," J. Applied Physics, vol. 47, No. 12, Dec. 1976, pp. 5248–5263.

M. Hartwell et al., "Strong Electron Emission From Patterned Tin–Indium Oxide Films", IEDM, 1975, pp. 519–521.

* cited by examiner

TEMPERATURE
ROOM TEMPERATURE
TIME
180°C
100°C
350°C
DEGREE OF VACUUM
$10^{-6}$Pa
$10^{-5}$Pa
$10^{-4}$Pa
$10^{-5}$Pa
TIME

METHOD AND APPARATUS FOR MANUFACTURING IMAGE DISPLAYING APPARATUS

BACKGROUND OF THE INVENTION

1. Field of the Invention

The present invention relates to an image displaying apparatus in which electron-emitting devices are arranged in matrix, more particularly to a method and an apparatus for manufacturing an image displaying apparatus having a display panel on which a rear plate (RP) provided with electron-emitting devices arranged in matrix and a face plate (FP) provided with phosphors are arranged in opposing positions as a first image forming member and as a second image forming member, respectively.

2. Related Background Art

Conventionally, an electron-emitting device is roughly divided into two known types, i.e., a thermal electron-emitting device and a cold-cathode electron-emitting device. The cold-cathode electron-emitting device includes the field emission type (hereinafter referred to as the FE type), the metal/insulation layer/metal type (hereinafter referred to the MIM type), the surface conducting type electron-emission device, and the like.

As an example of the FE type, an electron-emission device disclosed in W. P. Dyke & W. W. Dolan, "Field Emission", Advance in Electron Physics, 8, 89 (1956), C. A. spindt, "PHYSICAL Properties of thin-film field emission cathodes with molybdenum cones", J. Appl. Phys., 47, 5248 (1976), or the like is known.

As an example of the MIM type, an electron-emission device disclosed in C. A. Mead, "Operation of Tunnel-Emission Devices", J. Appl. Phys., 32, 646 (1961) or the like is known.

As an example of the surface conducting type electron-emission device type, an electron-emission device disclosed in M. I. Elinson, Radio Eng. Electron Phys., 10, 1290 (1965) or the like is known.

A surface conducting type electron-emission device is to utilize a phenomenon that generates electron emission by flowing electric current to a thin film with a small area formed on a substrate in parallel with the surface of the film. As the surface conducting type electron-emission device, one using an $SnO_2$ thin film by Elinson, et al. mentioned above, one using an Au thin film [G. Dittmer: "Thin Solid Films," 9, 317 (1972)], one using an $In_2O_3/SnO_2$ thin film [M. Hartwell and C. G. Fonstad: "IEEE Trans. ED Conf.", 519 (1975)], one using a carbon thin film [Araki Hisashi, et al.: Shinku, Vol. 26, No. 1, page 22 (1983)] and the like are known.

For the manufacture of an image displaying apparatus using the above-mentioned electron-emitting device, a process for manufacturing a display panel is used which comprises the steps of: preparing an electron source substrate on which such electron-emitting devices are arranged in matrix as an RP and preparing a phosphor substrate to be an FP provided with phosphors that emit light due to excitation by an electron beam; disposing the FP and the RP in opposing positions by disposing a spacer providing an envelope and an anti-atmospheric pressure structure such that the electron-emitting elements and the phosphors will be inside and; sealing the inside using a low-melting point material such as frit glass, indium or the like as a sealing material; and sealing off a vacuum exhaust pipe provided in advance after vacuum exhausting the inside from the vacuum exhaust pipe.

The manufacturing method according to the conventional art described above requires considerably long time for manufacturing one display panel, thus is not suitable for manufacturing a display panel inside of which requires the vacuum degree of $1\times10^{-6}$ Pa or more.

The drawback of this conventional art was solved by a method described, for example, in the Japanese Patent Application Laid-open No. 11-135018.

In the method described in the Japanese Patent Application Laid-open No. 11-135018, since only a step of sealing two substrates after positioning an FP and an RP in a single vacuum chamber is used, the above-mentioned other steps such as bake processing, getter processing, electron beam clean processing and the like that are necessary for preparing a display panel needs to be applied in the single vacuum chamber respectively. In addition, since movements of the FP and the RP between vacuum chambers are performed upon loosing evacuated state into non-vacuum state, each vacuum chamber is evacuated every time when an FP and an RP are carried therein. Due to these reasons, manufacturing process time is long. Therefore, considerable reduction of manufacturing process time has been required, and at the same time, it has been required to attain high vacuum degree of $1\times10^{-6}$ Pa or more in a display panel during a final manufacturing step in a short time.

SUMMARY OF THE INVENTION

It is an object of the present invention to enable to easily attain reduction of vacuum exhaust time and high vacuum degree in manufacturing an image displaying apparatus, thereby improving efficiency of manufacturing.

According to one aspect of the present invention, a method of manufacturing an image displaying apparatus comprising the steps of:

a: preparing a first substrate on which phosphor exciting means is disposed and a second substrate on which phosphors emitting light by the phosphor exciting means under the vacuum atmosphere;

b: carrying one or both of the first and the second substrates into a getter processing chamber in the vacuum atmosphere under the vacuum atmosphere, and subjecting to getter processing the one substrate carried or one or both of the substrates carried; and c: carrying the first and the second substrates in a seal processing chamber in the vacuum atmosphere under the vacuum atmosphere, and heat sealing the substrates in an opposing state is provided.

According to another aspect of the present invention, a method of manufacturing an image displaying apparatus comprising the steps of:

a: preparing a first substrate on which phosphor exciting means is disposed and a second substrate on which phosphors emitting light by the phosphor exciting means under the vacuum atmosphere;

b: carrying the first and the second substrates into a bake processing chamber in the vacuum atmosphere under the vacuum atmosphere and subjecting to bake processing both the substrates at predetermined temperature; and c: carrying the first and the second substrates in a seal processing chamber in the vacuum atmosphere under the vacuum atmosphere, and heat sealing the substrates in an opposing state is provided.

According to a still another aspect of the present invention, an apparatus for manufacturing an image displaying apparatus comprising:

a: a conveying means for conveying a first substrate provided with a first member for an image displaying apparatus and a second substrate provided with a second member for an image displaying apparatus;

b: a first vacuum chamber in which one or both of the first and the second substrates can be carried under the vacuum atmosphere by the conveying means;

c: getter giving means, arranged in the first vacuum chamber, having a getter precursor and getter activating means for activating the getter precursor;

d: a second vacuum chamber in which the first and the second substrates can be carried in under the vacuum atmosphere by the conveying means;

e: substrate arranging means, arranged in the second vacuum chamber toward inside, for arranging the first and the second substrates in positions opposite to each other by orienting the first and the second members for an image displaying apparatus toward inside; and f: sealing means, arranged in the second vacuum chamber, for heat sealing the first and the second substrates arranged in opposing positions by the substrate arranging means at predetermined temperature is provided.

According to a further aspect of the present invention, an apparatus for manufacturing an image displaying apparatus comprising:

a: a conveying means for conveying a first substrate provided with a first member for an image displaying apparatus and a second substrate provided with a second member for an image displaying apparatus;

b: a first vacuum chamber in which the first and the second substrates can be carried under the vacuum atmosphere by the conveying means;

c: baking means, arranged in the first vacuum chamber, for bake processing the carried first and the second substrates by heating the first and second substrates and;

d: a second vacuum chamber in which the first and the second substrates can be carried under the vacuum atmosphere by the conveying means;

e: substrate arranging means, arranged in the second vacuum chamber, for arranging the first and the second substrates in positions opposite to each other by orienting the first and the second members for an image displaying apparatus toward inside; and f: sealing means, arranged in the second vacuum chamber, for heat sealing the first and the second substrates arranged in opposing positions by the substrate arranging means at predetermined temperature is provided.

DETAILED DESCRIPTION OF THE PREFERRED EMBODIMENTS

Figures 1A, 1B, 1C:
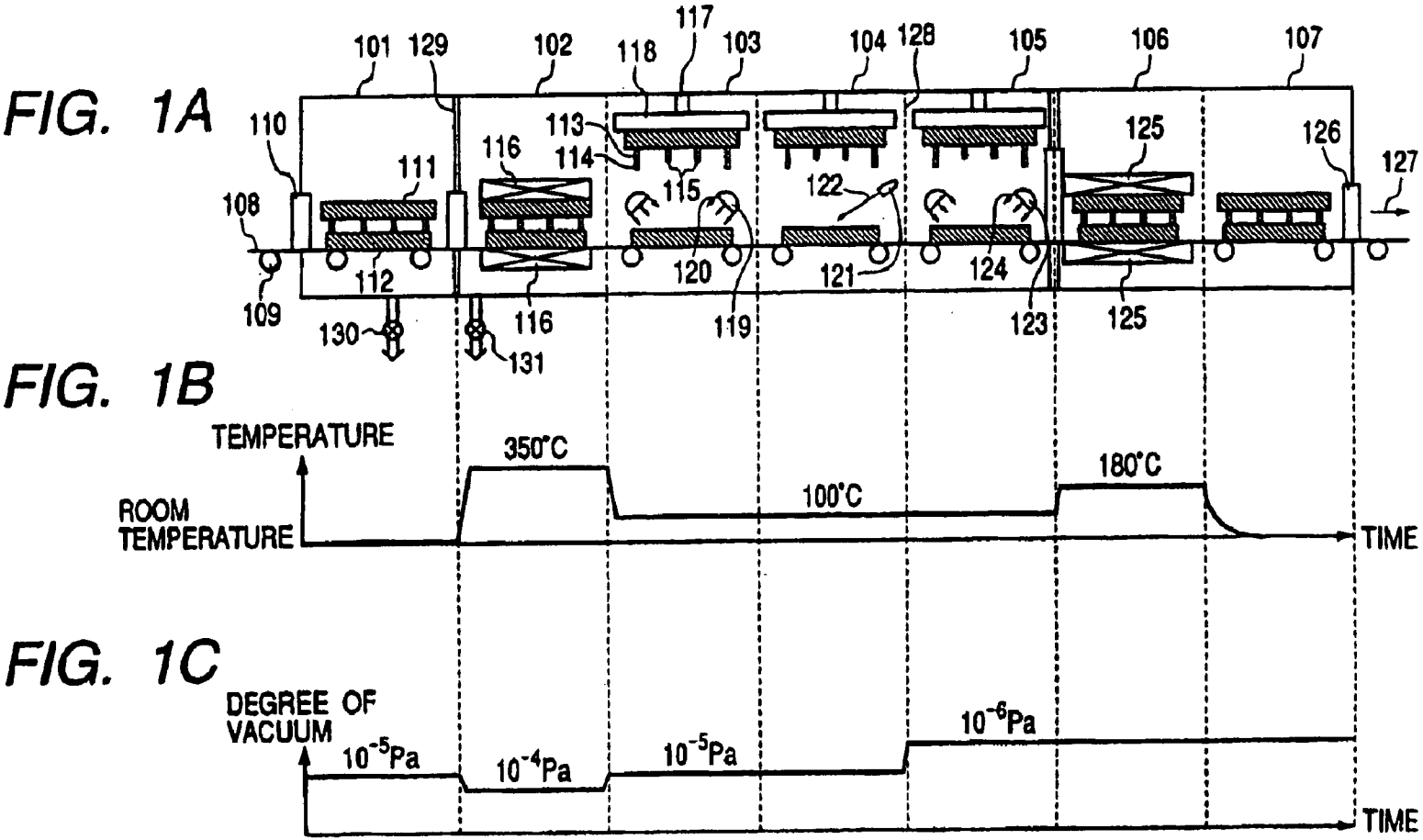
FIGS. 1A, 1B and 1C are schematic cross-sectional views of an apparatus according to a one example of the present invention.

First, the present invention is a method of manufacturing an image displaying apparatus, which is characterized by comprising the steps of:

a: preparing a first substrate on which phosphor exciting means is disposed and a second substrate on which phosphors emitting light by the phosphor exciting means under the vacuum atmosphere;

b: carrying one or both of the first and the second substrates into a getter processing chamber in the vacuum atmosphere under the vacuum atmosphere, and subjecting to getter processing the one substrate carried or one or both of the substrates carried; and c: carrying the first and the second substrates in a seal processing chamber in the vacuum atmosphere under the vacuum atmosphere, and heat sealing the substrates in an opposing state.

Secondly, the present invention is a method of manufacturing an image displaying apparatus, which is characterized by comprising the steps of:

a: preparing a first substrate on which phosphor exciting means is disposed and a second substrate on which phosphors emitting light by the phosphor exciting means under the vacuum atmosphere;

b: carrying the first and the second substrates into a bake processing chamber in the vacuum atmosphere under the vacuum atmosphere and subjecting to bake processing both the substrates at predetermined temperature; and c: carrying the first and the second substrates in a seal processing chamber in the vacuum atmosphere under the vacuum atmosphere, and heat sealing the substrates in an opposing state.

Thirdly, the present invention is a method of manufacturing an image displaying apparatus, which is characterized by comprising the steps of:

a: preparing a first substrate on which phosphor exciting means is disposed and a second substrate on which phosphors emitting light by the phosphor exciting means under the vacuum atmosphere;

b: carrying the first and the second substrates into a bake processing chamber in the vacuum atmosphere under the vacuum atmosphere, and subjecting to bake processing both the substrates at predetermined temperature;

c: carrying one or both of the first and the second substrates into a getter processing chamber in the vacuum atmosphere under the vacuum atmosphere, and getter processing the carried one substrate or one or both of the carried substrates; and d: carrying the first and the second substrates in a seal processing chamber in the vacuum atmosphere under the vacuum atmosphere, and heat sealing the substrates in an opposing state.

Fourthly, the present invention is a method of manufacturing an image displaying apparatus, which is characterized by comprising the steps of:

a: preparing a first substrate on which phosphor exciting means is disposed and a second substrate on which phosphors emitting light by the phosphor exciting means under the vacuum atmosphere;

b: carrying the first and the second substrates into a bake processing chamber in the vacuum atmosphere under the vacuum atmosphere and subjecting to bake processing both the substrates at predetermined temperature;

c: carrying one or both of the first and the second substrates into a first getter processing chamber in the vacuum atmosphere under the vacuum atmosphere, and first getter processing the carried one substrate or one or both of the carried substrates;

d: carrying one or both of the first and the second substrates into an electron beam clean processing chamber in the vacuum atmosphere under the vacuum atmosphere, and electron beam clean processing the carried one substrate or one or both of the carried substrates;

e: carrying one or both of the first and the second substrates into a second getter processing chamber in the vacuum atmosphere under the vacuum atmosphere, and second getter processing the carried one substrate or one or both of the carried substrates; and f: carrying the first and the second substrates into a seal processing chamber in the vacuum atmosphere under the vacuum atmosphere, and heat sealing the substrates in an opposing state.

Fifthly, the present invention is an apparatus for manufacturing an image displaying apparatus, which is characterized by comprising:

a: a conveying means for conveying a first substrate provided with a first member for an image displaying apparatus and a second substrate provided with a second member for an image displaying apparatus;

b: a first vacuum chamber in which one or both of the first and the second substrates can be carried under the vacuum atmosphere by the conveying means;

c: getter giving means arranged in the first vacuum chamber having a getter precursor and getter activating means for activating the getter precursor;

d: a second vacuum chamber in which the first and the second substrates can be carried under the vacuum atmosphere by the conveying means;

e: substrate arranging means, arranged in the second vacuum chamber toward inside, for arranging the first and the second substrates in positions opposite to each other by orienting the first and the second members for an image displaying apparatus toward inside; and f: sealing means, arranged in the second vacuum chamber, for heat sealing the first and the second substrates arranged in opposing positions by the substrate arranging means at predetermined temperature.

Sixthly, the present invention is an apparatus for manufacturing an image displaying apparatus, which is characterized by comprising:

a: a conveying means for conveying a first substrate provided with a first member for an image displaying apparatus and a second substrate provided with a second member for an image displaying apparatus;

b: a first vacuum chamber in which the first and the second substrates can be carried under the vacuum atmosphere by the conveying means;

c: baking means, arranged in the first vacuum chamber, for bake processing the carried first and the second substrates by heating the first and second substrates;

d: a second vacuum chamber in which the first and the second substrates can be carried under the vacuum atmosphere by the conveying means;

e: substrate arranging means, arranged in the second vacuum chamber, for arranging the first and the second substrates in positions opposite to each other by orienting the first and the second members for an image displaying apparatus toward inside; and f: sealing means, arranged in the second vacuum chamber, for heat sealing the first and the second substrates arranged in opposing positions by the substrate arranging means at predetermined temperature.

Seventhly, the present invention is an apparatus for manufacturing an image displaying apparatus, which is characterized by comprising:

a: a conveying means for conveying a first substrate provided with a first member for an image displaying apparatus and a second substrate provided with a second member for an image displaying apparatus;

b: a first vacuum chamber in which the first and the second substrates can be carried under the vacuum atmosphere by the conveying means;

c: baking means, arranged in the first vacuum chamber, for bake processing the carried first and the second substrates by heating the first and second substrates;

d: a second vacuum chamber in which the first and the second substrates can be carried under the vacuum atmosphere by the conveying means;

e: getter giving means arranged in the second vacuum chamber having a getter precursor and getter activating means for activating the getter precursor;

f: a third vacuum chamber in which the first and the second substrates can be carried under the vacuum atmosphere by the conveying means;

g: substrate arranging means, arranged in the third vacuum chamber, for arranging the first and the second substrates in positions opposite to each other by orienting the first and the second members for an image displaying apparatus toward inside; and h: sealing means, arranged in the third vacuum chamber, for heat sealing the first and the second substrates arranged in opposing positions by the substrate arranging means at predetermined temperature.

Eighthly, the present invention is an apparatus for manufacturing an image displaying apparatus, which is characterized by comprising:

a: a conveying means for conveying a first substrate provided with a first member for an image displaying apparatus and a second substrate provided with a second member for an image displaying apparatus;

b: a first vacuum chamber in which the first and the second substrates can be carried under the vacuum atmosphere by the conveying means;

c: baking means, arranged in the first vacuum chamber, for bake processing the carried first and the second substrates by heating the in first and second substrates;

d: a second vacuum chamber in which the first and the second substrates can be carried under the vacuum atmosphere by the conveying means;

e: getter giving means arranged in the second vacuum chamber having a getter precursor and getter activating means for activating the getter precursor;

f: a third vacuum chamber in which one or both of the first and the second substrates can be carried under the vacuum atmosphere by the conveying means;

g: electron beam cleaning means, arranged in the third vacuum chamber, for applying electron beam clean processing by irradiating electron beams;

h: a fourth vacuum chamber in which one or both of the first and the second substrates can be carried under the vacuum atmosphere by the conveying means;

i: second getter giving means arranged in the fourth vacuum chamber having a getter precursor and getter activating means for activating the getter precursor;

j: a fifth vacuum chamber in which one or both of the first and the second substrates can be carried under the vacuum atmosphere by the conveying means;

k: substrate arranging means, arranged in the fifth vacuum chamber, for arranging the first and the second substrates in positions opposite to each other by orienting the first and the second members for an image displaying apparatus toward inside; and l: sealing means, arranged in the fifth vacuum chamber, for heat sealing the first and the second substrates arranged in opposing positions by the substrate arranging means at predetermined temperature.

Ninthly, the present invention is an apparatus for manufacturing an image displaying apparatus, characterized by comprising:

a: a conveying means for conveying a first substrate provided with a first member for an image displaying apparatus and a second substrate provided with a second member for an image displaying apparatus;

b: a first decompression chamber in which the first substrate carried by the conveying means can be carried without being exposed to the atmosphere while maintaining a decompressed state;

c: getter giving means arranged in the first decompression chamber having a getter precursor and getter activating means for activating the getter precursor;

d: a second decompression chamber, to which getters are given, in which the first and the second substrates can be carried without being exposed to the atmosphere;

e: substrate arranging means, arranged in the second decompression chamber, for arranging the first and the second substrates in positions opposite to each other by orienting the first and the second members for an image displaying apparatus toward inside; and f: sealing means, arranged in the second decompression chamber, for sealing the first and the second substrates arranged in opposing positions by the substrate arranging means by heating the first and the second substrates at predetermined temperature.

Tenthly, the present invention is an apparatus for manufacturing an image displaying apparatus, characterized by comprising:

a: a conveying means for conveying a first substrate provided with a first member for an image displaying apparatus and a second substrate provided with a second member for an image displaying apparatus;

b: a first decompression chamber in which the first and the second substrates carried in by the conveying means can be carried without being exposed to the atmosphere while maintaining a decompressed state;

c: getter giving means arranged in the first decompression chamber having a getter precursor and getter activating means for activating the getter precursor;

d: a second decompression chamber in which the first and the second substrates in the first decompression chamber can be carried without being exposed to the atmosphere;

e: substrate arranging means, arranged in the second decompression chamber, for arranging the first and the second substrates in positions opposite to each other by orienting the first and the second members for an image displaying apparatus toward inside; and f: sealing means, arranged in the second decompression chamber, for sealing the first and the second substrates arranged in opposing positions by the substrate arranging means by the first and the second substrates at predetermined temperature.

Eleventh, the present invention is an apparatus for manufacturing an image displaying apparatus, which is characterized by comprising:

a: a conveying means for conveying a first substrate provided with a first member for an image displaying apparatus and a second substrate provided with a second member for an image displaying apparatus;

b: a first decompression chamber in which the first and the second substrates carried in by the conveying means can be carried without being exposed to the atmosphere while maintaining a decompressed state;

c: baking means, arranged in the first decompression chamber, for bake processing the carried first and the second substrates by heating the substrates;

d: first getter giving means, arranged in the first decompression chamber or a second decompression chamber in which the first and the second substrates can be carried from the first decompression chamber without being exposed to the atmosphere, having a getter precursor and getter activating means for activating the getter precursor;

e: a third decompression chamber in which the first and the second substrates can be carried from the first or the second decompression chamber without being exposed to the atmosphere;

f: substrate arranging means, arranged in the third decompression chamber, for arranging the first and the second substrates in positions opposite to each other by orienting the first and the second members for an image displaying apparatus toward inside; and g: sealing means, arranged in the third decompression chamber, for sealing the first and the second substrates arranged in opposing positions by the substrate arranging means by heating the first and the second substrates at predetermined temperature.

Twelfth, the present invention is an apparatus for manufacturing an image displaying apparatus, which is characterized by comprising:

a: a conveying means for conveying a first substrate provided with a first member for an image displaying apparatus and a second substrate provided with a second member for an image displaying apparatus;

b: a first decompression chamber in which the first and the second substrates carried in by the conveying means can be carried without being exposed to the atmosphere while maintaining a decompressed state;

c: baking means, arranged in the first decompression chamber, for bake processing the carried first and the second substrates by heating the substrates;

d: first getter giving means, arranged in the first decompression chamber or a second decompression chamber in which the first and the second substrates can be carried from the first decompression chamber without being exposed to the atmosphere, having a getter precursor and getter activating means for activating the getter precursor;

e: a third decompression chamber in which the first and the second substrates can be carried from the first or the second decompression chamber without being exposed to the atmosphere;

f: electron beam cleaning means, arranged in the third decompression chamber, for cleaning the first and the second substrates by irradiating electron beams to the first and the second substrates;

g: a fourth decompression chamber in which the first and the second substrates can be carried from the third decompression chamber without being exposed to the atmosphere;

h: second getter giving means, arranged in the fourth decompression chamber, having a getter precursor and getter activating means for activating the getter precursor;

i: a fifth decompression chamber in which the first and the second substrates can be carried from the fourth decompression chamber without being exposed to the atmosphere;

j: substrate arranging means, arranged in the fifth decompression chamber, for arranging the first and the second substrates in positions opposite to each other by orienting the first and the second members for an image displaying apparatus toward inside; and k: sealing means, arranged in the fifth decompression chamber, for sealing the first and the second substrates arranged in opposing positions by the substrate arranging means by heating the first and the second substrates at predetermined temperature.

In addition, the present invention includes the following features as its preferred aspects:

in the above-mentioned first and the second aspects, the steps a, b and c are steps set on one line, and a heat shielding member formed of reflective metal or the like is disposed between the getter processing chamber and the seal processing chamber;

in the above-mentioned first and the second aspects, the steps a, b and c are steps set on one line, and a load lock is disposed between the getter processing chamber and the seal processing chamber;

in the above-mentioned first and the second aspects, the steps a, b and c are set on a star arrangement, and the getter processing chamber and the seal processing chamber are partitioned by an independent chamber;

in the above-mentioned third aspect, the steps a, b, c and d are steps set on one line, and a heat shielding material formed of reflective metal or the like is disposed between the bake processing chamber and the getter processing chamber, between the bake processing chamber and the seal processing chamber, or between the bake processing chamber, the getter processing chamber and the seal processing chamber, respectively;

in the above-mentioned third aspect, the steps a, b, c and d are steps set on one line, and a load lock is disposed the bake processing chamber and the getter processing chamber, between the bake processing chamber and the seal processing chamber, or between the bake processing chamber, the getter processing chamber and the seal processing chamber, respectively;

in the above-mentioned third aspect, the steps a, b, c and d are arranged on a star arrangement, and the bake processing chamber, the getter processing chamber and the seal processing chamber are partitioned by an independent chamber;

in the above-mentioned fourth aspect, the steps a, b, c, d, e and f are steps set on one line, and a heat shielding member formed of reflective metal or the like is disposed between the bake processing chamber and the first getter processing chamber, between the first getter processing chamber and the electron beam clean processing chamber, between the electron beam clean processing chamber, or between the second getter processing chamber and the seal processing chamber;

in the above-mentioned fourth aspect, the steps a, b, c, d, e and f are steps set on one line, and a load lock is disposed between the bake processing chamber and the first getter processing chamber, between the first getter processing chamber and the electron beam clean processing chamber, between the electron beam clean processing chamber, or between the second getter processing chamber and the seal processing chamber;

in the above-mentioned fourth aspect, the steps a, b, c, d, e and f are set on a star arrangement, and the bake processing chamber, the first getter processing chamber, the electron beam clean processing chamber, the second getter processing chamber and the seal processing chamber are partitioned by independent chambers;

in the above-mentioned fifth and the sixth aspects, the first vacuum chamber and the second vacuum chamber are arranged on one line;

in the above-mentioned fifth and the sixth aspects, the first vacuum chamber and the second vacuum chamber are arranged on one line, and each chamber is partitioned by a heat shielding member formed of reflective metal;

in the above-mentioned seventh aspect, the first vacuum chamber, the second vacuum chamber and the third vacuum chamber are arranged on one line, and each chamber is partitioned by a heat shielding member formed of reflective metal or the like;

in the above-mentioned seventh aspect, the first vacuum chamber, the second vacuum chamber and the third vacuum chamber are arranged on one line, and each chamber is partitioned by a load lock;

in the above-mentioned seventh aspect, the first vacuum chamber, the second vacuum chamber and the third vacuum chamber are provided on a star arrangement, and each chamber is partitioned by an independent chamber;

in the above-mentioned eighth aspect, the first vacuum chamber, the second vacuum chamber, the third vacuum chamber, the fourth vacuum chamber and the fifth vacuum chamber are arranged on one line, and each chamber is partitioned by a heat shielding member formed of reflective metal or the like;

in the above-mentioned eighth aspect, the first vacuum chamber, the second vacuum chamber, the third vacuum chamber, the fourth vacuum chamber and the fifth vacuum chamber are arranged on one line, and each chamber is partitioned by a load lock; and in the above-mentioned eighth aspect, the first vacuum chamber, the second vacuum chamber, the third vacuum chamber, the fourth vacuum chamber and the fifth vacuum chamber are provided on a star arrangement, and each chamber is partitioned by an independent chamber.

Moreover, in the above-mentioned ninth through twelfth aspects, the first through fifth decompression chambers contain inert gases such as an argon gas, a neon gas or the like, or a hydrogen gas under decompression. In addition, in the above-mentioned ninth through twelfth aspects, the first member for an image displaying apparatus is a plasma generating device, and the second member for an image displaying apparatus is a phosphor or a color filter.

FIG. 1A schematically illustrates a manufacturing apparatus in accordance with the present invention, FIG. 1B shows a temperature profile in which a process temperature is indicated on a vertical axis with respect to time on a horizontal axis, and FIG. 1C shows a vacuum degree profile in which a vacuum degree is indicated on a vertical axis with respect to time on a horizontal axis. On example of a manufacturing method and a manufacturing apparatus in accordance with the present invention will be hereinafter described with reference to these drawings.

In an apparatus illustrated in FIG. 1A, a front chamber 101, a bake processing chamber 102, a first step getter processing chamber 103, an electron beam clean processing chamber 104, a second getter processing chamber 105, a seal processing chamber 106 and a cool chamber 107 are serially arranged in a carrying direction (an arrow 127 in FIG. 1A), and an RP 111 and an FP 112 serially pass through each chamber in the arrow 127 direction by driving a carrying roller 109 and a carrying belt 108 and are applied various kinds of processing during the passage. That is, steps of preparation under the vacuum atmosphere in the front chamber 101, bake processing in the bake processing chamber 102, first getter processing in the first step getter processing chamber 103, cleaning by electron beam irradiation in the electron beam clean processing chamber 104, second getter processing in the second step getter processing chamber 105, heat sealing in the seal processing chamber 106 and cool processing in the cool chamber 107 are respectively performed on one serial line.

Preferably, a heat shielding member 128 (in a plate form, a film form, etc.) formed of reflective metal reflecting radiative heat and an infrared ray such as aluminum, chromium and stainless steel is disposed between each chamber. The heat shielding member 128 may be disposed between chambers with different temperature profiles, for example, either between the bake processing chamber 102 and the first step getter processing chamber 103 or between the second step getter processing chamber 105 and the seal processing chamber 106 or optimally both, but may be disposed between each chamber. In addition, the heat shielding member 128 is disposed such that it does not hinder the FP 112 mounted on the carrying belt 108 and the RP 111 fixed on an elevating device when they move between each chamber.

A load lock 129 is disposed between the front chamber 101 and the bake processing chamber 102 illustrated in FIG. 1A. The load lock 129 is to open and close between the front chamber 101 and the bake processing chamber 102. In addition, a vacuum exhaust system 130 is connected to the front chamber 101 and a vacuum exhaust system 131 if connected to the bake processing chamber 102.

After carrying the RP 111 and the FP 112 in the front chamber 101, a carrying-in port 110 is shielded and, at the same time, the load lock 129 is shielded, thereby vacuum exhausting inside the front chamber 101 by the vacuum exhaust system 130. During this operation, insides of all of the bake processing chamber 102, the first step getter processing chamber 103, the electron beam clean processing chamber 104, the second step getter processing chamber 105, the seal processing chamber 106 and the cool chamber 107 are vacuum exhausted by the vacuum exhaust system 131 to bring them in a vacuum exhausted state.

When the front chamber 101 and other chambers following the front chamber 101 has reached the vacuum exhausted state, the load lock 129 is opened, the RP 111 and the FP 112 are carried out of the front chamber 101 and carried in the bake processing chamber 102, the load lock 129 is shielded after completing carrying in the RP 111 and FP 112, then the carrying-in port 110 is opened, and another RP 111 and FP 112 are carried in the front chamber 101, thereby repeating the steps of vacuum exhausting inside of the front chamber 101 by the vacuum exhaust system 130.

In the present invention, it is preferable to dispose a load lock (not shown) identical with the load lock 129. A pump (evacuation exhaust system) is arranged in each of the chambers separated by a load lock. The load lock may be disposed between respective chambers, but it is preferable to dispose the load lock between the chambers with different vacuum degree of a vacuum degree profile shown in FIG. 1C, for example, either between the bake processing chamber 102 and the first step getter processing chamber 103 or between the electron beam clean processing chamber 104 and the second step getter processing chamber 105 or optimally both.

In the present invention, it is preferable to fixedly provide an envelope sealing a vacuum structure and a spacer 115 forming an anti-atmosphere structure on the RP 111 in advance before carrying it in the front chamber 101. In a position corresponding to the envelope 113 of the FP 112, a sealing material 114 using low melting point material such as frit glass or low melting point metal such as indium, or an alloy thereof may be provided. In addition, as illustrated, the sealing material 114 may be provided in the envelope 113.

Heat processing (bake processing) by a heating plate 116 is applied to the RP 111 and the FP 112 carried in the bake processing chamber 102 without being exposed to the atmosphere in the bake processing chamber 102. By this bake processing, impurity gasses such as hydrogen gas, steam and oxygen contained in the RP 111 and the FP 112 can be displaced. A bake processing temperature at this point is generally 300° C. to 400° C., preferably 350° C. to 380° C. A vacuum degree at this point is approximately $1\times10^{-4}$ Pa.

The RP 111 and the FP 112 completing the bake processing are carried in the first step getter processing chamber 103, the RP 111 is fixed on a holder 118 and moved the upper part of the chamber 103, a getter flash 120 of an evaporable getter material (e.g., a getter material made of barium, etc.) contained in a getter flash apparatus 119 is generated and activated with respect to the FP 112, thereby depositing a getter film (not shown) consisting of a barium film or the like on the surface of the FP 112. A film thickness of the first step getter at this point is generally 5 nm to 500 nm, preferably 10 nm to 100 nm, more preferably 20 nm to 50 nm. In addition, in the present invention, a getter film or a getter material consisting of a titanium material, an NEG material or the like may be provided on the RP 111 or the FP 112 in advance other than the above-mentioned getter material.

As the holder 118, an appliance that can be fixed by a force sufficient for the RP 111 not to drop, for example, an appliance utilizing a electrostatic chuck method or a mechanical chuck method may be used.

The RP 111 fixed on the holder 118 is elevated to a position sufficiently distant from the FP 112 on the conveying roller 108 by the elevating device 117. In elevating the RP 111, an interval between the RP 111 and the FP 112 is preferably an interval sufficient for enlarging conductance between both the substrates, although it depends on a size of a used vacuum chamber. An interval between both the substrates is generally sufficient if it is 50 mm or more.

In addition, in the above-mentioned step, if a barium getter is used, a process temperature of the fist step getter processing chamber is set at approximately 100° C. A vacuum degree then is $1\times10^{-5}$ Pa.

Although only the FP 112 is shown as being irradiated the getter flash 120 in FIG. 1A, in the present invention, it is also possible to give a getter by irradiating a getter flash 120 similar to the above-mentioned one to the RP 111 only or both of the RP 111 and the FP 112. In addition, the first getter flash may be performed within the bake processing chamber 102 in order to increase vacuum degree of the vacuum atmosphere during and after the bake processing in the bake processing chamber 102.

Subsequently, when the RP 111 and the FP 112 are carried in the electron beam clean processing chamber 104 without being exposed to the atmosphere, the RP 111 and/or the FP 112 is scanned with an electron beam 122 by an electron beam oscillator 121 in the electron beam clean processing chamber 104, and particularly when impurity gasses in the phosphor (not shown) of the FP 112 are displaced in carrying in the RP 111 and the FP 112, as an interval between the RP 111 held on the elevating device 117 and the FP 112 held on the conveying belt 108, the interval in the previous first step getter processing step is preferably maintained without change.

Although only the FP 112 is shown as being applied the electron beam clean processing, in the present invention, it is also possible to apply electron beam clean processing similar to the above-mentioned one to the RP 111 only or both of the RP 111 and the FP 112.

After the above-mentioned electron beam clean processing, the RP 111 and the FP 112 are carried in the second step getter processing chamber 105 without being exposed to the atmosphere, thereby generating a getter flash 124 from the getter flash apparatus 123 by a method similar to that of the first step getter processing chamber 103 and giving getter to the FP 112. In giving getter to the FP 112, a film thickness of a second step getter is generally 5 nm to 500 nm, preferably 10 nm to 100 nm, more preferably 20 nm to 50 nm. In carrying in the RP 111 and the FP 112, as an interval between the RP 111 held on the elevating device 117 and the FP 112 held on the conveying belt 108, the interval in the previous first step getter processing step is preferably maintained without change. In addition, a second getter may be given only to the RP 111 or may be given to both of the FP 112 and the RP 111 in the similar manner as the first step getter.

The FP 112 to which the second step getter is given and the RP 111 positioned in the upper part of the second step getter processing chamber 105 by the elevating device 117 is lowered, thereby carrying the FP 112 and the RP 111 in the next seal processing chamber 106 without being exposed to the atmosphere. In carrying in the FP 112 and the RP 111, the elevating device 117 is operated such that the spacer 115 and the envelope 113 is arranged in opposing positions until the spacer 115 and the envelope 113 contact each other while orienting the RP 111 and the FP 112 toward inside which are provided with electron beam emitting devices and phosphors arranged in matrix on respective substrates.

A heating plate 125 is caused to act on the RP 111 and the FP 112 that are arranged in opposing positions in the seal processing chamber 106, and if the sealing material 114 provided in advance is made of low melting point metal such as indium, the sealing material 114 is heated until the low melting point metal melts, or if the sealing material 114 is made of non-metal low melting point material such as frit glass, the sealing material 114 is heated up to a temperature at which the low melting point material is affected and takes on adhesiveness. In FIG. 1B, the temperature is set at 180° C. as an example in which indium is used as the sealing material 114.

A vacuum degree in the seal processing chamber 106 may be set high at $1\times10^{-6}$ Pa or more. Thus, a vacuum degree of a display panel sealed by the RP 111, the FP 112 and the envelope 113 may also be set high at $1\times10^{-6}$ Pa or more.

A display panel produced in the seal processing chamber 106 is carried out to the next cool chamber 107 and cooled slowly.

The apparatus of the present invention is provided with a load lock (not shown) similar to the load lock 129 between the sealing chamber 106 and the cool chamber 107, and when the load lock is opened, a display panel is carried out of the seal processing chamber 106, the load lock is shielded after carried in the cool chamber 107, the carrying-out port 126 is opened after slow cooling, the display panel is carried out from the cool chamber 107, and lastly the carrying-out port 126 is shielded to complete all the processing. In addition, before starting the next process, inside of the cool chamber 107 is preferably set in a vacuum state by a vacuum exhaust system (not shown) that is independently disposed.

Further, according to the present invention, inert gasses such as argon gas or neon gas, or hydrogen gas may be contained in each of the chambers 101 through 107 under depressurized condition.

Although the above-described example is a best mode, as a first variation, there is an example in which the chambers are serialized such that process proceeds in the order of preparation under the vacuum atmosphere in the front chamber 101, first getter processing in the first step getter processing chamber, heat sealing in the seal processing chamber 106 and cool processing in the cool chamber 107.

As a second variation, there is an example in which the chambers are serialized such that process proceeds in the order of preparation under the vacuum atmosphere in the front chamber 101, bake processing in the bake processing chamber 102, heat sealing in the seal processing chamber 106, and cool processing in the cool chamber 107.

As a third variation, there is an example in which the chambers are serialized such that process proceeds in the order of preparation under the vacuum atmosphere in the front chamber 101, bake processing in the bake processing chamber 102, first getter processing in the first step getter processing chamber, heat sealing in the seal processing chamber 106, and cool processing in the cool chamber 107.

As a fourth variation, there is an example in which the RP 111 and the FP 112 are conveyed by separate conveying means.

Figure 2:
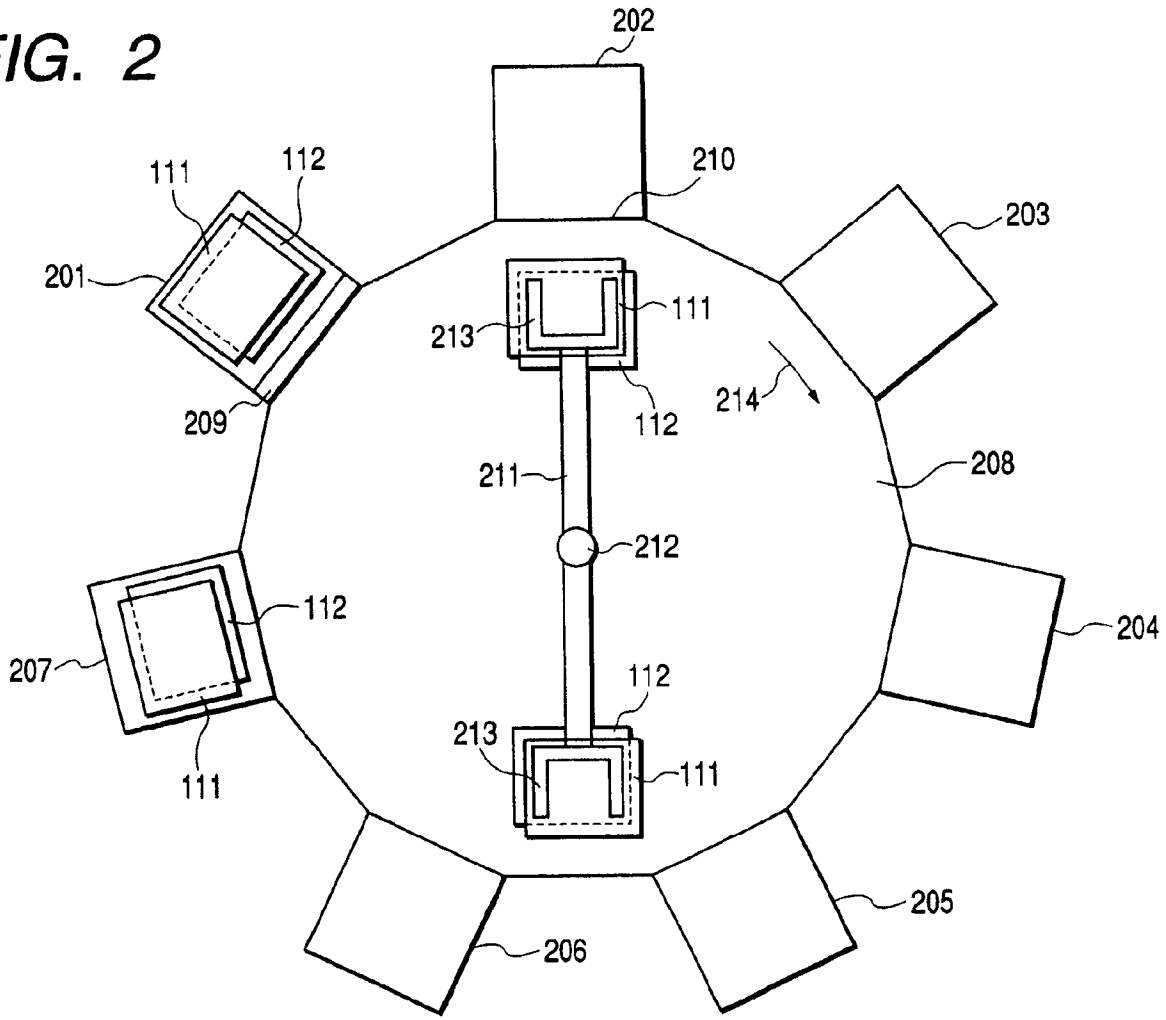
FIG. 2 is a schematic plan view of an apparatus according to an another example of the present invention.

FIG. 2 is a schematic plan view of an apparatus in which a front chamber 201, a bake processing chamber 202, a first step getter processing chamber 203, an electron beam clean processing chamber 204, a second step getter processing chamber 205, a seal processing chamber 206 and a cool chamber 207 are provided around a central vacuum chamber 208 in a star arrangement. The chambers 201 through 207 are partitioned by an independent chamber, respectively.

In the apparatus of FIG. 2, although a load lock 209 is provided between the front chamber 201 and the central vacuum chamber 208, similar load locks may be used for the other chambers 202 through 207 such that all the chambers 201 through 207 and the central vacuum chamber 208 can be partitioned by the load locks. In addition, instead of the load lock provided between the bake processing chamber 202 and the central vacuum chamber 208, a heat shield material 210 may also be used. Further, similarly, instead of the load locks provided between the other chambers 203 through 207 and the central vacuum chamber 208 respectively, heat shielding materials 210 may also be used.

In the central vacuum chamber 208, a conveying bar 211 is provided, on which both ends, conveying bands 213 that make the RP 111 and the FP 112 fixable by the electrostatic chuck method or the mechanical chuck method. The conveying bands 213 are provided on a conveying bar 211 that makes the RP 111 and the FP 112 rotatable in the direction of an arrow 214, respectively.

By repeating carrying in and carrying out of the RP 111 and the FP 112 for each of the chambers 201 through 207 according to the movement of the conveying band 213, each processing step is applied. In applying each processing step, although all the processing steps may be applied for both the substrates on the RP 111 and the FP 112, it is preferable to process predetermined step for one of both the substrates on the RP 111 and the FP 112. For example, instead of processing all the steps for both the substrates on the RP 111 and the FP 112 as described above, it is also possible to carry in only the FP 112 in first step getter processing chamber 203 and the second step getter processing chamber 205, where getter processing is applied only to the FP 112, and during the processing, to make the RP 111 wait in the central vacuum chamber 208, and to omit getter processing for the RP 111.

In addition, according to the present invention, inert gasses such as argon gas or neon gas, or hydrogen gas may be contained in each of the chambers 201 through 207 and the central vacuum chamber 208 under depressurized condition.

Figure 3:
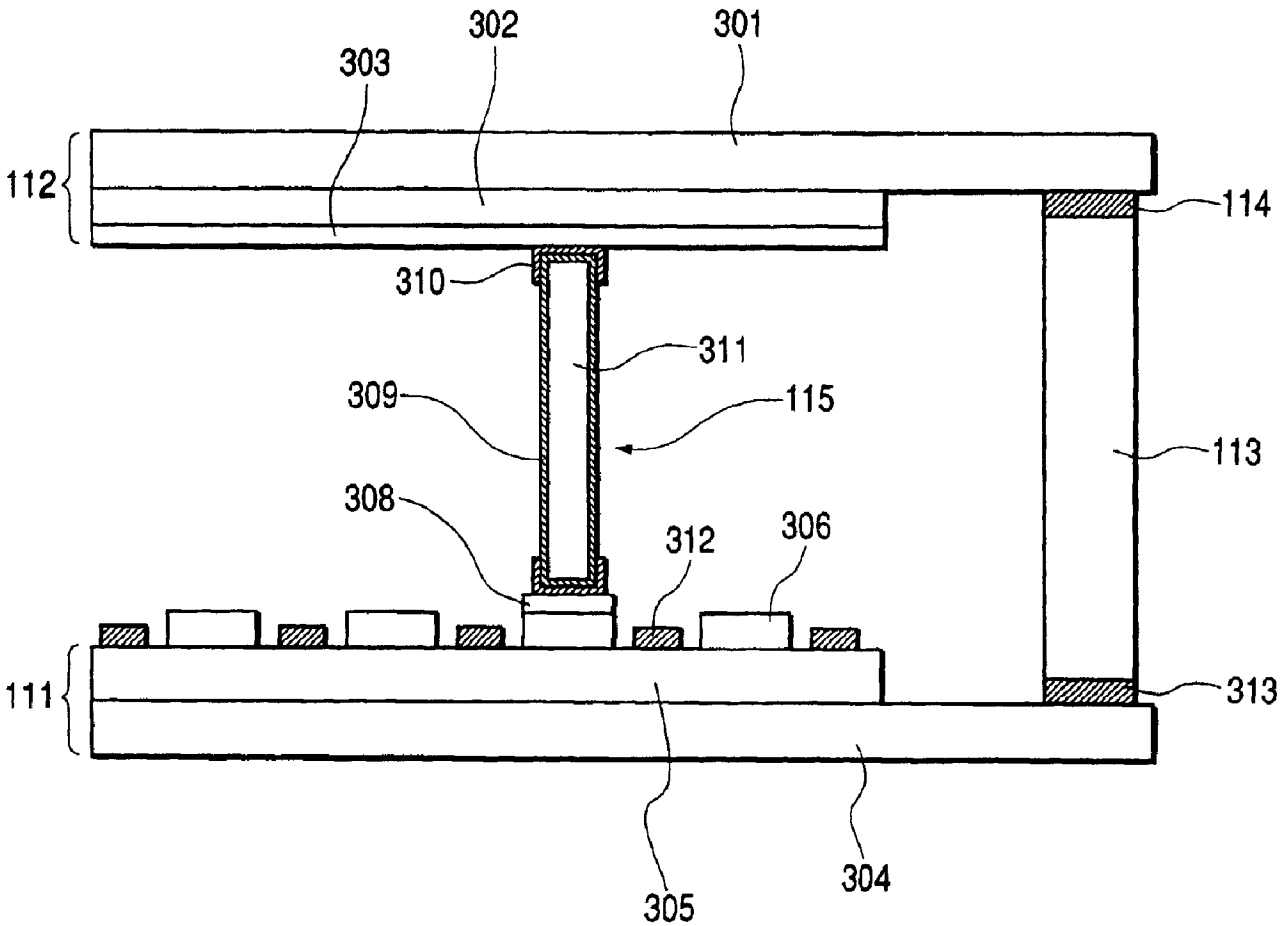
FIG. 3 is a cross-sectional view of an image displaying apparatus that is manufactured according to an apparatus and a method of the present invention.

FIG. 3 is a cross sectional view of an image displaying apparatus that is produced using an apparatus and a method of the present invention.

In the figure, symbols identical with those in FIGS. 1A and 2 refer to identical parts. In an image displaying apparatus produced according to the apparatus and the method, a vacuum container and a decompression container are formed by the RP 111, the FP 112 and the envelope 113. In the decompression container, inert gasses such as argon gas or neon gas, or hydrogen gas may be contained under depressurized condition.

In addition, in the case of the vacuum container, a vacuum degree may be set high at $1\times10^{-5}$ Pa or more, preferably $1\times10^{-6}$ Pa or more.

In the vacuum container and the decompression container, the spacer 115 is provided to form a anti-atmosphere structure. The spacer 115 used in the present invention has a main body 311 made of non-alkaline insulating material such as non-alkaline glass, metal (tungsten, copper, silver, gold, molybdenum, alloy of these metals, or the like) films 308 and 310 provided on both sides of a high resistance film 309 formed of a high resistance material disposed covering the surface of the main body 311, and is electrically connected and adhered to wiring 306 via conductive adhesive. If the spacer 115 is carried in the front chamber 101 or 201, the spacer 115 is adhesively fixed to the RP 111 on its one end in advance by low melting point adhesive 307 such as frit glass, and when the processing is completed in the seal processing chamber 106 or 206, the other end of the spacer 115 and the FP 112 are electrically connected and contactingly disposed.

In the RP 111, a transparent substrate 304 made of glass or the like, a foundation film ($SiO_2$, $SnO_2$, etc.) 305 for preventing alkaline such as sodium from entering, and a plurality of electron beam emitting device 312 arranged in a XY matrix. The wiring 306 forms wiring on one cathode side of XY matrix wiring on the cathode side connected with the electron beam emitting device.

In the present invention, instead of the electron beam emitting device 312 used as phosphor exciting means or an image displaying device member, a plasma generating device may be used. In using a plasma generating device, inert gasses such as argon gas or neon gas, or hydrogen gas are contained in a container under depressurized condition.

In the FP 112, a transparent substrate 301 made of glass or the like, a phosphor layer 302 and an anode metal (aluminum, silver, copper, etc.) film 303 connected to an anode source (not shown) are disposed.

In addition, in the present invention, when the plasma generating device is used, a color filter can be used instead of the phosphor used as an image displaying member.

When carrying the envelope 113 in the front chamber 101 or 201, the envelope 113 is adhesively fixed to the RP 111 in advance by low melting point adhesive 303 such as frit glass, and is fixedly adhered by the sealing material 114 using indium or frit glass in the processing step in the seal processing chamber 106 or 206.

According to the present invention, when providing the electron emitting device or the plasma generating device in the XY direction in large quantity such as 100 million pixels or more, and manufacturing an image displaying apparatus on which the large quantity pixels are provided on a large screen with a diagonal size of 30 inches or more, manufacturing process time can be substantially reduced and, at the same time, a high vacuum degree of $1\times10^{-6}$ Pa or more can be attained in a vacuum container forming the image displaying apparatus.

Thus, it is seen that a method and an apparatus for manufacturing an image displaying apparatus are provided. One skilled in the art will appreciate that the present invention can be practiced by other than the preferred embodiments which are presented for the purposes of illustration and not of limitation, and the present invention is limited only by the claims which follow.

What is claimed is:

1. A method of manufacturing an image displaying apparatus, comprising the steps of:

a: preparing a first substrate on which phosphor exciting means is disposed and a second substrate on which phosphors emitting light by said phosphor exciting means is disposed under the vacuum atmosphere;

b: carrying said second substrate or both of said first and second substrates into a getter processing chamber in the vacuum atmosphere under the vacuum atmosphere, and subjecting to getter processing by flashing an evaporation type getter to a surface of said second substrate at which the phosphors are disposed, thereby forming a getter film on the surface of said second substrate at which the phosphors are disposed; and c: carrying said first and second substrates into a seal processing chamber in the vacuum atmosphere under the vacuum atmosphere, and heat sealing said substrates in an opposing state, wherein each processing chamber is evacuated into $10^{-4}$ Pa or more lower pressure.

2. A method of manufacturing an image displaying apparatus according to claim 1, wherein said steps a, b and c are steps set on one line.

3. A method of manufacturing an image displaying apparatus according to claim 1, wherein said steps a, b and c are steps set on one line, and a heat shielding member is disposed between said getter processing chamber and said seal processing chamber.

4. A method of manufacturing an image displaying apparatus according to claim 3, wherein said heat shielding member is formed of reflective metal.

5. A method of manufacturing an image displaying apparatus according to claim 1, wherein said steps a, b and c are steps set on one line, and a load lock is disposed between said getter processing chamber and said seal processing chamber.

6. A method of manufacturing an image displaying apparatus according to claim 1, wherein said steps a, b and c are steps set on a star arrangement.

7. A method of manufacturing an image displaying apparatus according to claim 1, wherein said steps a, b and c are steps set on a star arrangement, and said getter processing chamber and said seal processing chamber are partitioned by an independent chamber.

8. A method of manufacturing an image displaying apparatus according to claim 1, wherein said phosphor exciting means has electron beam emitting means.

9. A method of manufacturing an image displaying apparatus according to claim 1, wherein said first substrate has an envelope fixedly disposed around said first substrate in advance.

10. A method of manufacturing an image displaying apparatus according to claim 1, wherein said first substrate has a spacer fixedly disposed inside said first substrate in advance.

11. A method of manufacturing an image displaying apparatus according to claim 1, wherein said first substrate has an envelope fixedly disposed around said first substrate and a spacer fixedly disposed inside said first substrate.

12. A method of manufacturing an image displaying apparatus according to claim 1, wherein said second substrate has an envelope fixedly disposed around said second substrate in advance.

13. A method of manufacturing an image displaying apparatus according to claim 1, wherein said second substrate has a spacer fixedly disposed inside said second substrate in advance.

14. A method of manufacturing an image displaying apparatus according to claim 1, wherein said second substrate has an envelope fixedly disposed around said second substrate and a spacer fixedly disposed inside said first substrate.

15. A method of manufacturing an image displaying apparatus according to claim 1, wherein said evaporation type getter is a barium getter.

16. A method of manufacturing an image displaying apparatus according to claim 1, wherein a sealing material used in said step c is a low melting point material.

17. A method of manufacturing an image displaying apparatus according to claim 16, wherein said low melting point material is a low melting point metal or an alloy of such a metal.

18. A method of manufacturing an image displaying apparatus according to claim 17, wherein said low melting point metal is indium or an alloy of indium.

19. A method of manufacturing an image displaying apparatus according to claim 16, wherein said low melting point material is frit glass.

20. A method of manufacturing an image displaying apparatus, comprising the steps of:

a: preparing a first substrate on which phosphor exciting means is disposed and a second substrate on which phosphors emitting light by said phosphor exciting means is provided under the vacuum atmosphere;

b: carrying said first and second substrates into a bake processing chamber in the vacuum atmosphere under the vacuum atmosphere and subjecting to bake processing both said substrates at predetermined temperature;

c: carrying said second substrate or both of said first and second substrates into a getter processing chamber in the vacuum atmosphere under the vacuum atmosphere, and subjecting to getter processing by flashing an evaporation type getter to a surface of said second substrate at which the phosphors are disposed, thereby forming a getter film on the surface of said second substrate at which the phosphors are disposed; and d: carrying said first and second substrates into a seal processing chamber in the vacuum atmosphere under the vacuum atmosphere, and heat sealing said substrates in an opposing state, wherein each processing chamber is evacuated into $10^{-4}$ Pa or more lower pressure.

21. A method of manufacturing an image displaying apparatus according to claim 20, wherein said steps a, b, c and d are steps set on one line.

22. A method of manufacturing an image displaying apparatus according to claim 20, wherein said steps a, b, c and d are steps set on one line, and a heat shielding member is disposed between said bake processing chamber and said getter processing chamber, between said bake processing chamber and said seal processing chamber, or between said bake processing chamber, said getter processing chamber and said seal processing chamber, respectively.

23. A method of manufacturing an image displaying apparatus according to claim 22, wherein said heat shielding member is formed of a reflective metal.

24. A method of manufacturing an image displaying apparatus according to claim 20, wherein said steps a, b, c and d are steps set on one line, and a load lock is disposed between said bake processing chamber and said getter processing chamber, between said bake processing chamber and said seal processing chamber, or between said bake processing chamber, said getter processing chamber and said seal processing chamber, respectively.

25. A method of manufacturing an image displaying apparatus according to claim 20, wherein said steps a, b, c and d are steps set on a star arrangement.

26. A method of manufacturing an image displaying apparatus according to claim 20, wherein the steps a, b, c and d are arranged on a star arrangement, and said bake processing chamber and said getter processing chamber, said getter processing chamber and said seal processing chamber, or said bake processing chamber and said seal processing chamber, are partitioned by an independent chamber.

27. A method of manufacturing an image displaying apparatus according to claim 20, wherein said phosphor exciting means has electron beam emitting means.

28. A method of manufacturing an image displaying apparatus according to claim 20, wherein said first substrate has an envelope fixedly disposed around said first substrate in advance.

29. A method of manufacturing an image displaying apparatus according to claim 20, wherein said first substrate has a spacer fixedly disposed inside said first substrate in advance.

30. A method of manufacturing an image displaying apparatus according to claim 20, wherein said first substrate has an envelope fixedly disposed around said first substrate and a spacer fixedly disposed inside said first substrate.

31. A method of manufacturing an image displaying apparatus according to claim 20, wherein said second substrate has an envelope fixedly disposed around said second substrate in advance.

32. A method of manufacturing an image displaying apparatus according to claim 20, wherein said second substrate has a spacer fixedly disposed inside said second substrate in advance.

33. A method of manufacturing an image displaying apparatus according to claim 20, wherein said second substrate has an envelope fixedly disposed around said second substrate and a spacer fixedly disposed inside said first substrate.

34. A method of manufacturing an image displaying apparatus according to claim 20, wherein said evaporation type getter is a barium getter.

35. A method of manufacturing an image displaying apparatus according to claim 20, wherein a sealing material used in the step c is a low melting point material.

36. A method of manufacturing an image displaying apparatus according to claim 35, wherein said low melting point material is a low melting point metal or an alloy of such a metal.

37. A method of manufacturing an image displaying apparatus according to claim 36, wherein said low melting point met al is indium or an alloy of indium.

38. A method of manufacturing an image displaying apparatus according to claim 35, wherein said low melting point material is frit glass.

39. A method of manufacturing an image displaying apparatus, comprising the steps of:

a: preparing a first substrate on which phosphor exciting means is disposed and a second substrate on which phosphors emitting light by said phosphor exciting means is disposed under the vacuum atmosphere;

b: carrying said first and second substrates into a bake processing chamber in the vacuum atmosphere under the vacuum atmosphere and subjecting to bake processing both said substrates at predetermined temperature;

c: carrying one or both of said first and second substrates into a first getter processing chamber in the vacuum atmosphere under the vacuum atmosphere, and subjecting to first getter processing said one substrate carried or one or both of said substrates carried;

d: carrying one or both of said first and second substrates into an electron beam clean processing chamber in the vacuum atmosphere under the vacuum atmosphere, and subjecting to electron beam clean processing said one substrate carried or one or both of said substrates carried;

e: carrying said second substrate or both of said first and second substrates into a second getter processing chamber in the vacuum atmosphere under the vacuum atmosphere, and subjecting to second getter processing by flashing an evaporation type getter to a surface of said second substrate at which the phosphors are disposed, thereby forming a getter film on the surface of said second substrate at which the phosphors are disposed; and f: carrying said first and second substrates into a seal processing chamber in the vacuum atmosphere under the vacuum atmosphere, and heat sealing said substrates in an opposing state, wherein each processing chamber is evacuated into $10^{-4}$ Pa or more lower pressure.

40. A method of manufacturing an image displaying apparatus according to claim 39, wherein said steps a, b, c, d, e and f are steps set on one line.

41. A method of manufacturing an image displaying apparatus according to claim 39, wherein said steps a, b, c, d, e and f are steps set on one line, and a heat shielding member is disposed between said bake processing chamber and said first getter processing chamber, between said first getter processing chamber and said electron beam clean processing chamber, between said electron beam clean processing chamber and said second getter processing chamber, or between said second getter processing chamber and said seal processing chamber.

42. A method of manufacturing an image displaying apparatus according to claim 41, wherein said heat shielding member is formed of a reflective metal.

43. A method of manufacturing an image displaying apparatus according to claim 39, wherein the steps a, b, c, d, e and f are steps set on one line, and a load lock is disposed between said bake processing chamber and said first getter processing chamber, between said first getter processing chamber and said electron beam clean processing chamber, between said electron beam clean processing chamber and said second getter processing chamber, or between said second getter processing chamber and said seal processing chamber.

44. A method of manufacturing an image displaying apparatus according to claim 39, wherein the steps a, b, c, d, e and f are set on a star arrangement.

45. A method of manufacturing an image displaying apparatus according to claim 39, wherein the steps a, b, c, d, e and f are set on a star arrangement, and said bake processing chamber, said first getter processing chamber, said electron beam clean processing chamber, said second getter processing chamber and said seal processing chamber are partitioned by independent chambers.

46. A method of manufacturing an image displaying apparatus according to claim 39, wherein said phosphor exciting means has electron beam emitting means.

47. A method of manufacturing an image displaying apparatus according to claim 39, wherein said first substrate has an envelope fixedly disposed around said first substrate in advance.

48. A method of manufacturing an image displaying apparatus according to claim 39, wherein said first substrate has a spacer fixedly disposed inside said first substrate in advance.

49. A method of manufacturing an image displaying apparatus according to claim 39, wherein said first substrate has an envelope fixedly disposed around said first substrate and a spacer fixedly disposed inside said first substrate.

50. A method of manufacturing an image displaying apparatus according to claim 39, wherein said second substrate has an envelope fixedly disposed around said second substrate in advance.

51. A method of manufacturing an image displaying apparatus according to claim 39, wherein said second substrate has a spacer fixedly disposed inside said second substrate in advance.

52. A method of manufacturing an image displaying apparatus according to claim 39, wherein said second substrate has an envelope fixedly disposed around said second substrate and a spacer fixedly disposed inside said first substrate.

53. A method of manufacturing an image displaying apparatus according to claim 39, wherein said getter used in the step b is an evaporation type getter.

54. A method of manufacturing an image displaying apparatus according to claim 53, wherein said evaporation type getter is a barium getter.

55. A method of manufacturing an image displaying apparatus according to claim 39, wherein a sealing material used in the step f is a low melting point material.

56. A method of manufacturing an image displaying apparatus according to claim 55, wherein said low melting point material is a low melting point metal or an alloy of such a metal.

57. A method of manufacturing an image displaying apparatus according to claim 56, wherein said low melting point metal is indium or an alloy of indium.

58. A method of manufacturing an image displaying apparatus according to claim 55, wherein said low melting point material is frit glass.

59. A method of manufacturing an image displaying apparatus, comprising the steps of:

a: a preparing a first substrate on which phosphor exciting means is disposed and a second substrate on which phosphors emitting light by said phosphor exciting means is disposed under a vacuum a atmosphere;

b: carrying under a vacuum atmosphere said first and second substrates into a bake processing chamber of which atmosphere is evacuated to subject both of said first and second substrates to a bake processing at a predetermined temperature;

c: carrying under a vacuum atmosphere one or both of said first and second substrates into a cleaning processing chamber of which atmosphere is evacuated, to subject one or both of the substrates carried therein to a cleaning processing;

d: carrying under the vacuum atmosphere said second substrate or both of said first and second substrates into a second getter processing chamber, and subjecting the substrate or substrates carried therein to a second getter processing by flashing an evaporation type getter to a surface of said second substrate on which the phosphor is disposed, thereby forming a getter film on the surface of said second substrate on which the phosphor is disposed; and e: carrying under the vacuum atmosphere said first and second substrates into a sealing processing chamber of which atmosphere is evacuated, and heat sealing said first and second substrates in an opposing state, wherein each processing chamber is evacuated into $10^{-4}$ Pa or more lower pressure.

60. A method of manufacturing an image displaying apparatus according to claim 59, wherein said cleaning processing includes a process of an electron beam irradiation onto the one substrate carried therein or one or both of the substrates carried therein.

61. A method of manufacturing an image displaying apparatus according to claim 59, wherein said cleaning processing includes an electron beam irradiation onto the surface of said second substrate on which the phosphor is disposed.

* * * * *

UNITED STATES PATENT AND TRADEMARK OFFICE

CERTIFICATE OF CORRECTION

PATENT NO. : 6,905,384 B2
APPLICATION NO. : 09/781305
DATED : June 14, 2005
INVENTOR(S) : Toshihiko Miyazaki et al.

It is certified that error appears in the above-identified patent and that said Letters Patent is hereby corrected as shown below:

ON THE TITLE PAGE [56] REFERENCES CITED:

Other Publications, after "H. Araki, et al.," "th" should read --the--; and
U. S. Patent Documents, "6,821,174 B2 * 11/2004 Nakata et al." should read --6,821,174 B2 * 11/2004 Kaneko et al.--.

COLUMN 1:

Line 43, "in" should be deleted.

COLUMN 2:

Line 37, "emitting" should read --emit--;
Line 54, "emitting" should read --emit--; and
Line 65, "a" should be deleted.

COLUMN 3:

Line 36, "substrates and;" should read --substrates;--; and
Line 55, "an" should be deleted.

COLUMN 4:

Line 1, "emitting" should read --emit--;
Line 33, "emitting" should read --emit--; and
Line 54, "emitting" should read --emit--.

COLUMN 6:

Line 42, "in" should be deleted.

Signed and Sealed this

Thirty-first Day of August, 2010

David J. Kappos

David J. Kappos
*Director of the United States Patent and Trademark Office*

COLUMN 9:

Line 39, “disposed” should read --disposed between--.

COLUMN 10:

Line 58, “On” should read --One--.

COLUMN 11:

Line 34, “if” should read --is--; and
Line 48, “has” should read --have--.

COLUMN 13:

Line 7, “applied” should read --applied to--; and
Line 36, “is” should read --are--.

COLUMN 15:

Line 14, “cross sectional” should read --cross-sectional--;
Line 29, “a” should read --an--; and
Line 48, “device” should read --devices--.

COLUMN 16:

Line 18, “other” should read --embodiments other--.

COLUMN 19:

Line 7, “met al” should read --metal--.

COLUMN 21:

Line 2, “a” (second occurrence) should be deleted.